US005532046A

United States Patent [19]

Rich et al.

[11] Patent Number: 5,532,046

[45] Date of Patent: Jul. 2, 1996

[54] SIMULATED FOIL CARD

[75] Inventors: Benny R. Rich, Oakwood; Jon M. Brawner, Duluth, both of Ga.

[73] Assignee: Dittler Brothers Incorporated, Atlanta, Ga.

[21] Appl. No.: 260,699

[22] Filed: Jun. 16, 1994

Related U.S. Application Data

[63] Continuation-in-part of Ser. No. 195,759, Feb. 14, 1994, abandoned.

[51] Int. Cl.[6] ..... B42D 15/00

[52] U.S. Cl. ..... 428/202; 283/94; 283/100; 283/102; 283/903; 428/195; 428/201; 428/206; 428/207; 428/208; 428/209; 428/211; 428/328; 428/500; 428/916

[58] Field of Search ..... 428/195, 913, 428/914, 210, 915, 916, 206, 207, 323, 201, 202, 208, 209, 211, 328, 500; 162/134, 135, 140, 162, 181.9; 283/94, 100, 102, 903

[56] References Cited

U.S. PATENT DOCUMENTS

| | | | |
|---|---|---|---|
| 4,507,349 | 3/1985 | Fromson et al. | 428/195 |
| 4,726,608 | 2/1988 | Walton | 283/96 |
| 5,037,475 | 8/1991 | Chida et al. | 106/403 |
| 5,213,664 | 5/1993 | Hansell | 162/134 |
| 5,286,061 | 2/1994 | Behm | 283/95 |
| 5,346,258 | 9/1994 | Behm et al. | 283/102 |

FOREIGN PATENT DOCUMENTS

| | | | |
|---|---|---|---|
| 63-95277 | 4/1988 | Japan | 428/207 |

OTHER PUBLICATIONS

Advertisement of Unifoil Corporation entitled "Introducing EnviroMET—A Recyclable Non–Foil Substrate for Instant Tickets" (one page; believed to have been published Apr. 1993).

Advertisement of Webcraft Games, Inc. entitled "A Message From Webcraft Games" (one page; believed to have been published Jan. 1994).

"Webcraft Reorganizes, Expands," *Public Gaming Magazine,* p. 20 (Sep. 1993).

"Webcraft Goes Green," *Public Gaming Magazine,* p. 11 (Jun. 1993).

"Foil–less printing by SciGames," *Gaming & Wagering Business* (one page; Jul. 15, 1993–Aug. 14, 1993).

"Lottery Pioneer Celebrates 20th Anniversary," *Public Gaming Magazine,* p. 4 (Apr. 1993).

"The Greening of the Lottery," *Gaming & Wagering Business,* pp. 18–19 and 22–23 (Jun. 15, 1993–Jul. 14, 1993).

Advertisement of Scientific Games, Inc. entitled "First There Was The Foil Ticket" (one page; believed to have been published Feb. 1993).

Advertisement of Webcraft Games, Inc. entitled "Rooted In Quality" (one page; believed to have been published in 1993).

Advertisement of BABN Technologies entitled "How Accurate Is Your Information About BABN Technologies" (one page; believed to have been published Nov. 1992).

"Lotteries and the environment," *AILE Review* (seven pages; believed to have been published in 1993).

Promotional Literature of Webcraft Games, Inc. entitled "Compare Webcraft Games' Green Ticket to Other Paper Ticket Stocks Available" *(one page; believed to have been disseminated in 1993).*

Promotional Literature of Pollard Banknote Limited entitled "Trees of Life" (card with insert; believed to have been disseminated in 1990).

Declaration of Benny R. Rich dated Jun. 10, 1994.

*Primary Examiner*—C. Hamilton Hess

*Attorney, Agent, or Firm*—Dean W. Russell; Kilpatrick & Cody

[57] ABSTRACT

A card, such as a lottery ticket or game piece, lacking a foil laminate is disclosed. To simulate the appearance of such a laminate, however, the card includes a substrate onto which metal particles are adhered. The particles are permanently suspended in a resinous ink binder, thus forming neither a sheet of material nor a continuous, solid film. To enhance the reflectivity of the card, a clear overcoat may be applied.

3 Claims, 2 Drawing Sheets

SIMULATED FOIL CARD

CROSS-REFERENCE TO RELATED APPLICATION

This application is a continuation-in-part of U.S. patent application Ser. No. 08/195,759, filed Feb. 14, 1994, now abandoned, entitled "Card," which application is incorporated herein in its entirety by this reference.

FIELD OF THE INVENTION

This invention relates to a card (such as a lottery ticket or game piece) which, although appearing to include a foil laminate, lacks such a metallic sheet or layer.

BACKGROUND OF THE INVENTION

As discussed in U.S. patent application Ser. No. 08/195,759, many existing instant-win lottery cards or tickets comprise a paper substrate to which foil is laminated. The foil is then coated both to minimize oxidation and to provide an ink-retaining surface onto which symbols may be printed. At least one additional sealant may be applied to the inked surface to protect the printed symbols, and a single opaque metallic latex covering used to obscure them from view. Post purchase or distribution, the ticket bearer, or player, typically removes ("scratches off") the latex covering to reveal the hidden symbols. Existing tickets often further include at least one "release" coat interposed between the latex covering and protective coating to facilitate the removal of the latex covering in use.

The paper substrate and foil combination employed in these existing tickets provides an opaque base onto which the hidden symbols are printed. In particular, introducing foil into the ticket prevents unscrupulous players from viewing the printed symbols by examining the ticket before a light source, a process known as candling. Using the non-porous foil also makes the ticket base more durable (and thus less susceptible to mechanical manipulation or damage) and prevents the hidden images from wicking to the underside of the base (where they might become visible).

Existing foil-based tickets are difficult to recycle, however, as the metal laminate interferes with conventional paper recycling processes. Although including foil in these cards or tickets reduces the possibility of electrostatic tampering with the hidden images, it also prevents electrostatic printing techniques from being employed, reducing the variety of graphics available for use. Empirical evidence further suggests that laminating foil to recycled paper fibers generally decreases the quality of the print surface as well.

A recently-introduced instant-win ticket appears to omit foil from its base, opting instead for a water-based black coating approximately one micron thick and comprised of carbon, chlorine, and calcium. This black coating is believed to be either identical or virtually identical to the composition of the ink used to print the hidden images on the ticket, thus diminishing the possibility that an unscrupulous player could distinguish the hidden images from the coating through candling. To contrast the hidden images from the black base coating once properly revealed, the ticket interposes a lighter-colored coating between them. This ticket also appears to include only a single (pink) coating over the hidden image for sealing it, potentially reducing the time necessary for unscrupulous players to scratch off the latex covering and remove both the sealant and hidden images of losing tickets (in order to substitute winning images for them). The black coating contains no fugitive dye to provide evidence of wicking, moreover, as none is necessary because of the coating's similarity to the ink used to print the hidden images.

SUMMARY OF THE INVENTION

The present invention provides a card simulating the appearance of but lacking a foil laminate. Instead of laminating foil to a paper substrate as in conventional cards, the invention comprises a substrate onto which metal particles are adhered. The metal particles are suspended in a resinous ink binder, producing a coating for the paper substrate that, when dried, permanently suspends the particles in the binder. As a result, the metal particles form neither a sheet of material nor a continuous, solid film.

In some embodiments of the invention, the ink binder includes aluminum pigment and a clear overcoat is also applied. Because the invention lacks a foil sheet, much of the light incident upon the card is refracted into the ink, where it is divided into specular components randomly reflected by the metal particles. Like foil, however, the aluminum pigment reflects incidental light, increasing the "holdout" (reflectivity) of the card and enhancing its sheen or gloss. The clear overcoat, with a binder similar to the applied ink, also improves the gloss of the card as well as the clarity of any overprinted inks.

It is therefore an object of the present invention to provide a card that lacks a foil laminate.

It is also an object of the present invention to provide a card that simulates the appearance of a foil layer.

It is another object of the present invention to provide an ink, for coating the card, in which metal particles are suspended in a resinous binder.

It is yet another object of the present invention to provide an ink containing metal particles for enhancing the reflectivity of the card.

It is a further object of the present invention to provide a card comprising a paper substrate, an ink coating such as that mentioned above, and a clear overcoat to promote the gloss or sheen of the card.

Other objects, features, and advantages of the present invention will become apparent with reference to the remainder of the written portion and the drawings of the application.

DETAILED DESCRIPTION

Figure 1:
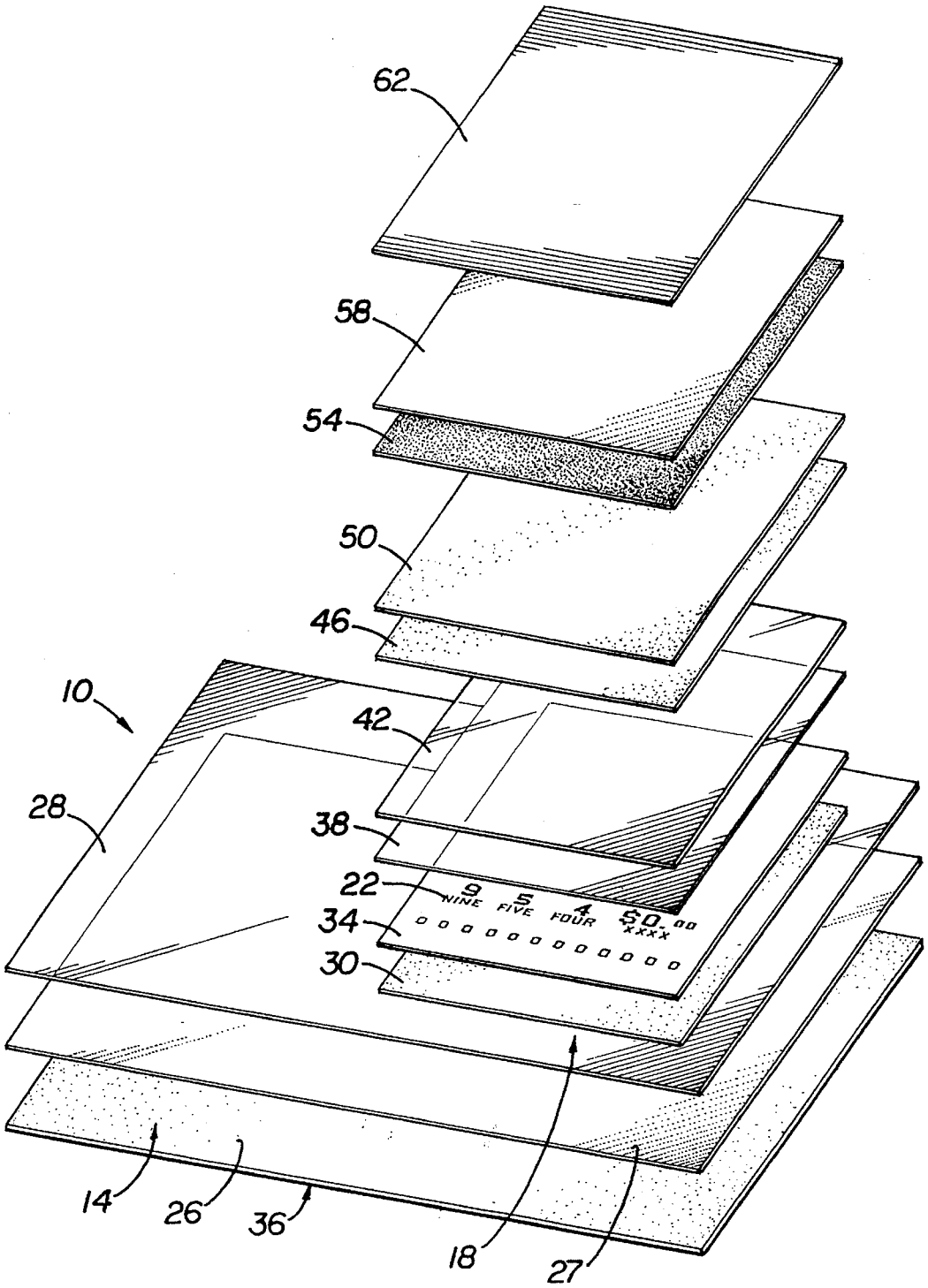
FIG. 1 is an exploded perspective view of a card of the present invention.

FIG. 1 illustrates an embodiment of card 10 of the present invention. If desired, card 10 may be divided into "unsecure" and "secure" areas 14 and 18, respectively, with symbols 22 printed in secure area 18. Such symbols 22, initially covered by opaque material (and therefore hidden from view), provide the information sought by the player or purchaser of card 10.

Card 10 typically comprises a paper base 26, which may (but need not) be conventional eight or ten point board stock. Unlike many existing instant-win lottery tickets, foil is not laminated to base 26. As a result, card 10 is easily recyclable, and base 26 itself may be formed from recycled fibers. Card 10 nevertheless provides many of the advantages of existing foil tickets, including resistance to known optical, magnetic, chemical, physical, artistic, and electrical compromise techniques and, when subjected to certain chemical tampering, evidence that such tampering has occurred.

Card 10 additionally simulates the appearance of existing foil tickets. Coated atop base 26 is metallic ink 27, which contains metal (typically aluminum) particles suspended in a resinous ink binder. When metallic ink 27 dries, the metal particles are dispersed throughout and permanently suspended in the binder, thus not forming a continuous, solid film or sheet.

In at least one embodiment of card 10, metallic ink 27 comprises, by weight:

| | |
|---|---|
| ethyl acetate | 32.50% |
| methyl ethyl ketone | 36.45% |
| vinyl resin | 23.00% |
| black dye | 0.05% |
| aluminum pigment | 8.00% |

More generally, to ensure acceptable adhesion metallic ink 27 typically comprises (by weight) 32–33% ethyl acetate, 30–37% methyl ethyl ketone, 23–24% vinyl resin, 0–0.05% black dye, and 8–12% aluminum pigment. Like foil, the aluminum pigment of metallic ink 27 reflects light incident on card 10, increasing the reflectivity, or "holdout," of the card 10 to enhance its sheen or gloss. Otherwise, because card 10 lacks a foil sheet, much of the light incident upon the card 10 would be refracted into metallic ink 27 and its specular components randomly reflected by the metal particles.

Clear overcoat 28 further improves the holdout of card 10. Matched to and applied atop metallic ink 27, overcoat 28 includes binder components similar to those of the metallic ink 27. Overcoat 28, for example, may be comprised of, by weight:

| | |
|---|---|
| ethyl acetate | 32.25% |
| methyl ethyl ketone | 39.75% |
| vinyl resin | 28.00% |

To enhance adherence to metallic ink 27, the quantity of vinyl resin present in overcoat 28 is typically 25–30%. Typical ranges for other components of overcoat 28 are 32–33% ethyl acetate and 37–40% methyl ethyl ketone. Metallic ink 27 generally includes slightly less vinyl resin than overcoat 28, permitting inclusion of additional aluminum pigment, to enhance the luster and uniform metallic appearance of card 10.

FIG. 1 shows additional ink layers and coatings that may be applied to enhance the security of card 10. As detailed in FIG. 1, foundation coating 30 covers the portion of base 26, metallic ink 27, and overcoat 28 in secure area 18. Foundation coating 30 increases the opacity of card 10, reducing the possibility of successful optical compromise through candling. Card 10 may also include contrast coating 34 if desired, typically a white or light-colored material onto which darker symbols are printed. Both foundation coating 30 and contrast coating 34 (when present) are adapted to receive the ink used to print symbols 22 and provide a durable surface to substitute for that furnished by the foil of existing instant-win tickets.

Foundation coating 30 comprises a dark-colored, solvent-soluble ink (e.g. gray or blue) with a high metal content (typically aluminum and possibly bronze or copper) and a vinyl chloride base resin. Foundation coating 30 additionally may, but need not, include carbon black to inhibit electrostatic tampering from the underside 36 of card 10. Like the foil of existing tickets, the colored ink and other contents of foundation coating 30 further prevent unscrupulous players from viewing symbols 22 by removing the fibers from base 26. A fugitive dye which may be incorporated in foundation coating 30 also is designed to bleed through underside 36 of card 10 when immersed in chemicals, evidencing an attempt to wick the ink of symbols 22 to underside 36 for viewing by an unscrupulous player. A suitable contrast coating 34 for card 10 is a vinyl chloride resin (dissolved in acetate solvent) with titanium dioxide pigment.

Seal coating 38 covers symbols 22 and functions as a barrier to seal symbols 22 from other coatings applied to card 10 and guard against chemical tampering by unscrupulous players. Card 10 may additionally include a second sealant 42 for similar purposes and to reduce reliance on automatic equipment fully covering symbols 22 with seal coating 38. In these embodiments, either or both of seal coating 38 and second sealant 42 may be a water-white solution of vinyl chloride resin. Although transparent, either seal coating 38 or second sealant 42 may be tinted if desired to inhibit or deter photocopying of symbols 22.

First and second release coatings 46 and 50, respectively, applied over seal coating 38, permit latex coverings 54 and 58 to be removed by the player to reveal symbols 22. Release coatings 46 and 50 typically contain alcohol-soluble polyamid resin and zinc stearate, with first release coating 46 additionally containing silicone. This structure permits card 10 to withstand greater temperatures without degradation than other typical non-foil pieces, reducing the possibility of successful heat-based tampering by unscrupulous players. Utilizing dual release coatings 46 and 50 allows each to be thinner than a single coat, furthermore, thereby drying more quickly and allowing more rapid processing through automatic equipment. Dual release coatings 46 and 50 also promote complete coverage of secure area 18 and facilitate more rapid and easier removal of respective first and second (latex) coverings 54 and 58 by the player.

Applied atop release coatings 46 and 50 is first covering 54. First covering 54 is an opaque, black latex comprised of solvent-soluble synthetic rubber with predispersed pigment and is available from KVK USA, 19A Home News Road, New Brunswick, N.J. 08901. Second covering 58, applied atop first covering 54, is also an opaque, solvent-soluble synthetic rubber containing predominantly metal particles (such as aluminum, copper, or bronze) and black pigment. First and second coverings 54 and 58 combine to inhibit candling, with the metallic composition and black pigment present additionally deterring certain chemical tampering of card 10. Because the synthetic rubber of first and second coverings 54 and 58 is an electrical insulator and does not react with acids or bases, card 10 is less likely to be electrically or chemically compromised by an unscrupulous player as well. In some embodiments of card 10, first covering 54 may also include metal particles to enhance opacity.

Overprint ink 62, finally, may also be applied to card 10. Because card 10 lacks the foil present in the existing instant-win tickets discussed above, electrostatic printing is possible in both unsecure and secure areas 14 and 18. This possibility increases the variety of applicable printing techniques, improving the graphical and other decorative or informational representations made using overprint ink 62.

Figure 2:
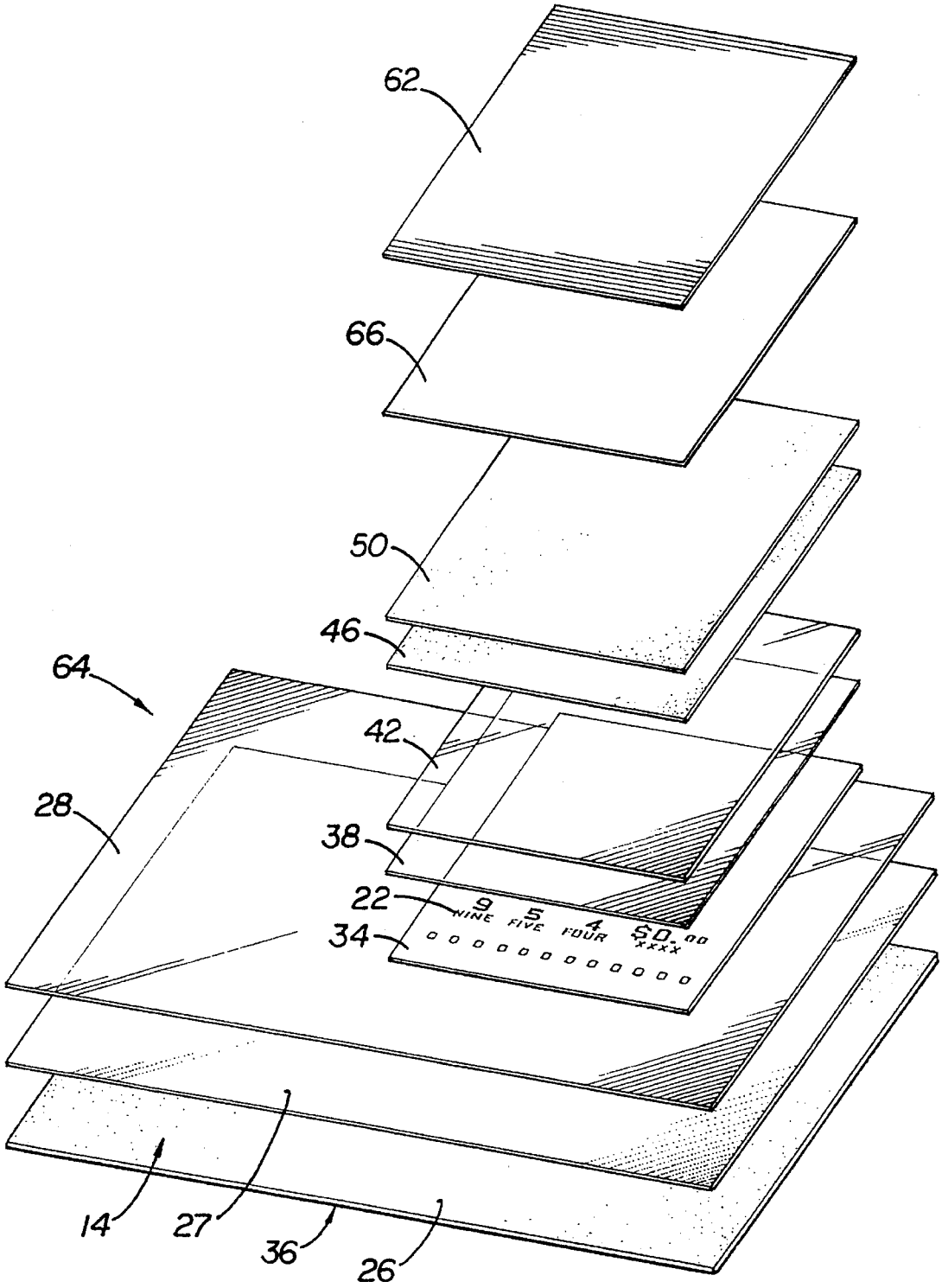
FIG. 2 is an exploded perspective view of an alternate embodiment of the card of FIG. 1.

FIG. 2 details card 64, a similar but alternative construction of card 10. Unlike card 10, card 64 omits foundation coating 30 and substitutes a single opaque, solvent-soluble synthetic rubber coating 66 for first and second coatings 54 and 58. Other highly opaque substrates (with or without security features), including those described in U.S. Pat. No. 5,213,664 to Hansell, may also be used as base 26. In some embodiments of the invention, moreover, a varnish cured by ultraviolet radiation may either be applied atop overprint ink 62 or incorporated into release coatings 46 or 50 to enhance the gloss of cards 10 and 64 and further seal the layers of the cards 10 and 64 from contaminants.

Although specific compositions of metallic ink 27 and overcoat 28 have been provided, other suitable compositions may be used as well. For example, metallic ink 27 may employ resins other than vinyl, such as acrylic, and may also be composed of water-based binder systems. Overcoat 28, similarly, may comprise other binders and solvent systems.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A card comprising:

a. a paper substrate;

b. an ink, applied atop the paper substrate, comprising metal particles suspended in a resinous binder;

c. an overcoat, applied atop the ink, comprising a resinous binder;

d. a vinyl chloride resin with titanium dioxide pigment applied atop the overcoat;

e. symbols printed atop the vinyl chloride resin;

f. a sealant applied atop the symbols;

g. a release coating applied atop the sealant; and an opaque covering comprising a solvent-soluble synthetic rubber applied atop the release coating.

2. A card comprising:

a. a substrate;

b. an ink, applied to the substrate, comprising metal particles suspended in a resinous binder;

c. an overcoat, applied atop the ink, comprising a resinous binder;

d. a vinyl chloride resin with titanium dioxide pigment applied atop the overcoat;

e. symbols printed atop the vinyl chloride resin;

f. a sealant applied atop the symbols;

g. a release coating applied atop the sealant; and h. an opaque covering comprising a solvent-soluble synthetic rubber applied atop the release coat.

3. A card comprising:

a. a substrate;

b. an ink, comprising metal particles, applied to the substrate;

c. an overcoat applied atop the ink;

d. a vinyl chloride resin applied atop the overcoat;

e. symbols printed atop the vinyl chloride resin;

f. a sealant applied atop the symbols;

g. a release coating applied atop the sealant; and h. an opaque covering comprising a solvent-soluble synthetic rubber applied atop the release coat.

* * * * *